US006231157B1

(12) United States Patent
Saijo

(10) Patent No.: US 6,231,157 B1
(45) **Date of Patent: *May 15, 2001**

(54) INK JET RECORDING APPARATUS COMPRISING IMPROVED CLEANING MECHANISM

(75) Inventor: Yasutsugu Saijo, Tokyo (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/296,598

(22) Filed: Apr. 23, 1999

(30) Foreign Application Priority Data

May 15, 1998 (JP) ..... 10-152242

(51) Int. Cl.[7] ..... B41J 2/165
(52) U.S. Cl. ..... 347/33
(58) Field of Search ..... 347/33

(56) References Cited

FOREIGN PATENT DOCUMENTS 5-202328 * 8/1993 (JP) .
8-193175 * 7/1996 (JP) .
10-226058 * 8/1998 (JP) .

* cited by examiner

*Primary Examiner*—N. Le
*Assistant Examiner*—Shih-Wen Hsieh
(74) *Attorney, Agent, or Firm*—Fitzpatrick, Cella, Harper & Scinto

(57) ABSTRACT

The present invention provides an ink jet recording apparatus in which during wiping of an ink jet head surface, ink accumulation on both sides of each wiping region can be removed, thereby preventing dropping and transfer of the ink accumulation onto a recording medium, and maintaining good image quality. In the ink jet recording apparatus, a second wiping operation, separate from a normal first wiping operation, is performed for wiping a discharge element relatively moved to a position shifted by a predetermined amount from a position in the first wiping operation in a direction perpendicular to the wiping direction.

20 Claims, 10 Drawing Sheets

INK JET RECORDING APPARATUS COMPRISING IMPROVED CLEANING MECHANISM

BACKGROUND OF THE INVENTION

1. Field of the Invention

The present invention relates to an ink jet recording apparatus in which a liquid such as ink or the like is discharged onto a recording medium in an ink jet recording system.

2. Description of the Related Art

A recording apparatus having the functions as a printer, a copying machine, a facsimile machine, etc., a composite electronic apparatus comprising a computer, a word processor, or the like, or a recording apparatus used as an output apparatus for a work station is constructed to record an image (including characters, symbols, and the like) on a recording medium (referred to as "recording paper" hereinafter) such as paper, cloth, a plastic sheet, an OHP sheet, or the like. These recording apparatuses can be divided into an ink jet type, a wire dot type, a thermal type, a laser beam type, etc. according to their recording systems.

In a serial type recording apparatus in which in recording, scanning is performed in the direction perpendicular to the transfer direction (the paper feed direction or sub-scanning direction) of the recording medium, an image is recorded (main scanning) by a discharge element (a recording head) which is moved along the recording medium, paper is fed (pitch transfer as sub-scanning) by a predetermined amount after completion of recording for one line, and then an image of a next line is recorded (main scanning) on the recording medium which is stopped. This operation is repeated to record the image on the desired range of the recording medium. On the other hand, in a line type recording apparatus in which recording is carried out only by sub-scanning in the transfer direction of the is recording medium, the recording medium is set at the predetermined recording position, and the paper is fed (pitch feed) by the predetermined amount during continuous batch recording of one line to record an image on the desired range of the recording medium.

In the ink jet type recording apparatus (ink jet recording apparatus), a liquid (ink) is discharged from the discharge element to the recording medium to record an image. Therefore, it is possible to easily make the discharge element compact, rapidly record a high-definition image, and record an image on plain paper without the need for special treatment. This recording apparatus can be run at low cost, causes low noise because of the non-impact system, and has the advantage of easily recording a color image by using many types of inks (for example, color inks).

The ink jet recording apparatus generally comprises driving means provided with a discharge element, for driving a carriage; transfer means for transferring the recording medium (recording paper), and control means for controlling the driving means and the transfer means. On the other hand, as an energy generating element for generating energy used for discharging ink from the nozzle of the discharge element, an element using an electromechanical transducer such as a piezo element, an element for discharging ink droplets by using the exothermic function caused by irradiation with an electromagnetic wave such as laser or the like, or an element for heating a liquid by using an electromechanical transducer having a heating resistor can be used.

Of these elements, the ink jet type discharge element (recording head) for discharging ink droplets by using thermal energy permits high-density arrangement of nozzles, thereby enabling high-resolution recording. Particularly, the discharge element using an electromechanical transducer as the energy generating element can easily be miniaturized, and sufficiently utilize the advantages of IC technology and microprocessing technology which have recently significantly been advanced in the semiconductor field with significant improvement in reliability. Further, high-density packaging can easily be realized, and the production cost is low. Therefore, the discharge element is advantageous.

There are also various requirements for the material of the recording medium. In recent years, development of these requirements has proceeded, and a recording apparatus has been used in which besides paper (including thin paper and processed paper) as a normal recording medium and a thin resin sheet (OHP sheet or the like), fabric, leather, nonwoven fabric, and a metal are used as the recording medium.

A conventional known ink used for the ink jet recording apparatus generally has a composition comprising water as a main component, and a water-soluble high-boiling-point solvent such as glycol or the like which is added for preventing drying and clogging of nozzles. In recording on plain paper by using such an ink, in some cases, the discharged ink is not sufficiently fixed to plain paper, and a nonuniform distribution of a filler or sizing agent on the surface of recording paper possibly causes a nonuniform image. Particularly, in the formation of a color image, inks of various colors are successively discharged to be overlapped at the same position of the recording paper before the inks are fixed, thereby causing a problem of color bleeding in the boundaries between images of different colors, or a problem of forming an unsatisfactory image due to nonuniform mixing of colors.

Therefore, in order to further improve the printing performance of the ink jet recording system, a method is known in which a treatment liquid (or a printability improving liquid) is coated as a liquid for improving the quality of an image on the recording medium before a recording ink is discharged.

For example, Japanese Patent Laid-Open No. 5-202328 discloses a recording method which uses an ink composition comprising at least one chemical dye containing at least one carboxyl group, and a polyvalent metal salt solution. In this method, the polyvalent metal salt solution is applied to the recording medium, and then the ink composition is applied to obtain a good image. Japanese Patent Laid-Open No. 8-193175 discloses an image forming method for obtaining good images, and a printability improving solution and an ink composition, both of which are used in this method.

In the ink jet recording apparatus, as a recovery method for removing clogging of the nozzle of the discharge element, a suction recovery method is used in which the nozzle surface is covered with a cap, and a negative pressure is generated in the cap to suction ink from the nozzle. In order to remove the ink remaining on the nozzle surface after suction recovery of such a discharge element (recording head), a so-called wiping operation is frequently carried out, in which a wiper comprising an elastic material such as rubber or the like is brought into contact with the nozzle surface in order to remove mist of the ink composition which is generated in discharge of the ink during printing and then adheres to the nozzle surface, so that a substance such as ink, mist or dust which adheres to the nozzle surface is removed by relatively moving the wiper to wipe the nozzle surface.

In the system which uses inter-reaction between a treatment solution and an ink composition, as disclosed in the above publication, Japanese Patent Laid-Open No. 10-226058 discloses a discharge element having the construction shown in FIG. 13. FIG. 13 is a plan view of an ink jet discharge element as viewed from the discharge direction of ink.

FIG. 13 shows a plurality of discharge elements for plain paper including black ink discharge elements $Bk_1$ and $Bk_2$, a cyan ink discharge element C, a magenta ink discharge element M, a yellow ink discharge element Y, and a discharge element S for discharging a treatment solution for making the dye contained in each of the inks insoluble. In an embodiment of this invention, the discharge elements are scanned in the direction shown by arrow b in FIG. 13 to discharge a printability improving solution from the printability improving solution head (the discharge element for the treatment solution) to recording paper and bring the printability improving solution into contact with the ink discharged from each of the heads (the ink discharge elements) on the recording paper. This provides the dye or the like with water resistance and momentarily makes insoluble the dye in the ink due to reaction with the printability improving solution, thereby sharpening the outline of an image derived from the dye or the like, and preventing bleeding. In recording using the treatment solution, care must be taken to prevent mixing of the treatment solution and ink, and the wiper must be completely separated between at least the treatment solution system and the ink composition system in order to prevent clogging of each of the liquid discharge heads (the discharge elements).

FIG. 14 is a schematic view of a wiping device for wiping the nozzle surface of the discharge elements shown in FIG. 13 as viewed from the movement direction of recording paper. In FIG. 14, the discharge elements (recording heads) 3 are loaded on a carriage 2 which can be scanned in the direction of arrow b, and six blades (wipers) 14 for the respective discharge elements are respectively provided at positions corresponding to the discharge elements of the recording heads 3 positioned at the predetermined positions (wiping positions) in the direction of arrow b. The blades 14 are arranged on a blade holder 15. The blade holder 15 is moved in the direction perpendicular to the drawing to wipe the discharge elements by the blades 14.

However, in the above-described construction, wiping causes the ink or the treatment solution to be pushed toward both sides of each of the wipers, thereby causing a portion remaining unwiped. In this state, recording causes adhesion of a mist and the like to the unwiped portion, and thus causes the phenomenon that a mixture of the ink and the printability improving solution is accumulated on both sides of each of the wiping regions. This finally possibly causes a state in which the accumulated mixture drops on the recording paper or is transferred thereto and thus stains the recorded image, thereby deteriorating image quality. An example of the mechanism of such a phenomenon is described with reference to FIGS. 15 and 16. FIG. 15 is a plan view showing the discharge elements in a state after wiping as viewed from the discharge direction of ink, and FIG. 16 is a schematic drawing showing ink droplets in a state after printing as viewed from the movement direction of recording paper.

In wiping for removing the ink remaining on the nozzle surface of each of the discharge elements after suction recovery, and mist of the ink composition or the like which is generated in discharge and adheres to the nozzle surface after discharge, the nozzle surface is put into a state in which the wiping region shadowed in the drawing which contacts each of the blades 14 is cleaned, and the removed ink is forced or excluded to both sides of the wiping region, as shown in FIG. 15. Therefore, stripes of the removed ink occur on the nozzle surface. In this state, a printing operation causes scattering of main droplets V, floating mist comprising small droplets, which are discharged from the nozzle N but do not reach the recording paper P, and the presence of mist R rebounding upon recording paper P between the discharge elements 3 and the recording paper P. These substances adhere to the nozzle surfaces of the discharge elements 3 with the operation of scanning the carriage 2.

At this time, when the mist adheres to the removed ink stripes on both sides of the wiping region, the mixture of the ink and the printability improving solution gradually grows. For example, when the mist of the printability improving solution discharged from the discharge element S adheres to the removed ink accumulations on the surface of the discharge element $Bk_2$, the dye in black ink reacts with the printability improving solution to be made insoluble. Then, the excluded ink Bk is accumulated by the next wiping operation, and the mist of the printability improving solution again adheres to the accumulated ink Bk to produce a reaction product. This is repeated to accumulate the mixture of the ink accumulated on both sides of the wiping region and the printability improving solution, and cause the growth thereof. The accumulated mixture finally contacts the recording paper during the operation of scanning the carriage 2, thereby staining an image.

SUMMARY OF THE INVENTION

The present invention has been achieved in consideration of the above-mentioned technical problems, and an object of the present invention is to provide an ink jet recording apparatus permitting appropriate selection of the frequency of the wiping operations, preventing dropping or transfer of the excluded ink on a recording medium by removing the ink excluded to both sides of the wiping region, and maintaining good image quality.

According to a first aspect of the present invention, a jet recording apparatus includes a jet discharge element, wiping means and control means. The wiping means wipes a surface of the jet discharge element in a wiping direction. The control means controls wiping operations of the wiping means. The control means controls first and second separate wiping operations such that a relative position between the wiping means and the jet discharge element in the second wiping operation is shifted by a predetermined amount, in a direction transverse to the wiping direction, from a relative position between the wiping means and the jet discharge element in the first wiping operation.

According to another aspect of the present invention, a cleaning method for a jet recording apparatus includes the steps of providing a jet discharge element, wiping a surface of the jet discharge element and controlling first and second separate wiping operations. The wiping step wipes the surface of the jet discharge element by relative movement of a wiping device and the jet discharge element in a wiping direction. The controlling step controls the first and second separate wiping operations of the wiping device such that a relative position between the wiping device and the jet discharge element in the second wiping operation is shifted by a predetermined amount, in a direction transverse to the wiping direction, from a relative position between the wiping device and the jet discharge element in the first wiping operation.

According to yet another aspect of the present invention, a recording apparatus includes at least one discharge element having a discharge face, a wiper and a controller. The wiper wipes the discharge face of the at least one discharge element, a width of the wiper being less than a width of the discharge face of at least one discharge element. The controller controls wiper operations by causing relative movement between the wiper and the at least one discharge element. The controller controls a first pass of the relative movement for removing a portion of matter disposed on the discharge face and a second pass of the relative movement for removing additional matter on the discharge face not removed in the first pass.

According to still another aspect of the present invention, a cleaning method for a recording apparatus includes the steps of providing at least one discharge element having a discharge face, wiping the discharge face and controlling wiper operations. The wiping step wipes the discharge face of the at least one discharge element. The controlling step controls the wiper operations by causing relative movement between the wiper and the at least one discharge element. The wiper operations include a first pass of the relative movement for removing a portion of matter disposed on the discharge face and a second pass of the relative movement for removing additional matter on the discharge face not removed in the first pass.

Further objects, features and advantages of the present invention will become apparent from the following description of the preferred embodiments with reference to the attached drawings.

DESCRIPTION OF THE PREFERRED EMBODIMENT

Figure 1:
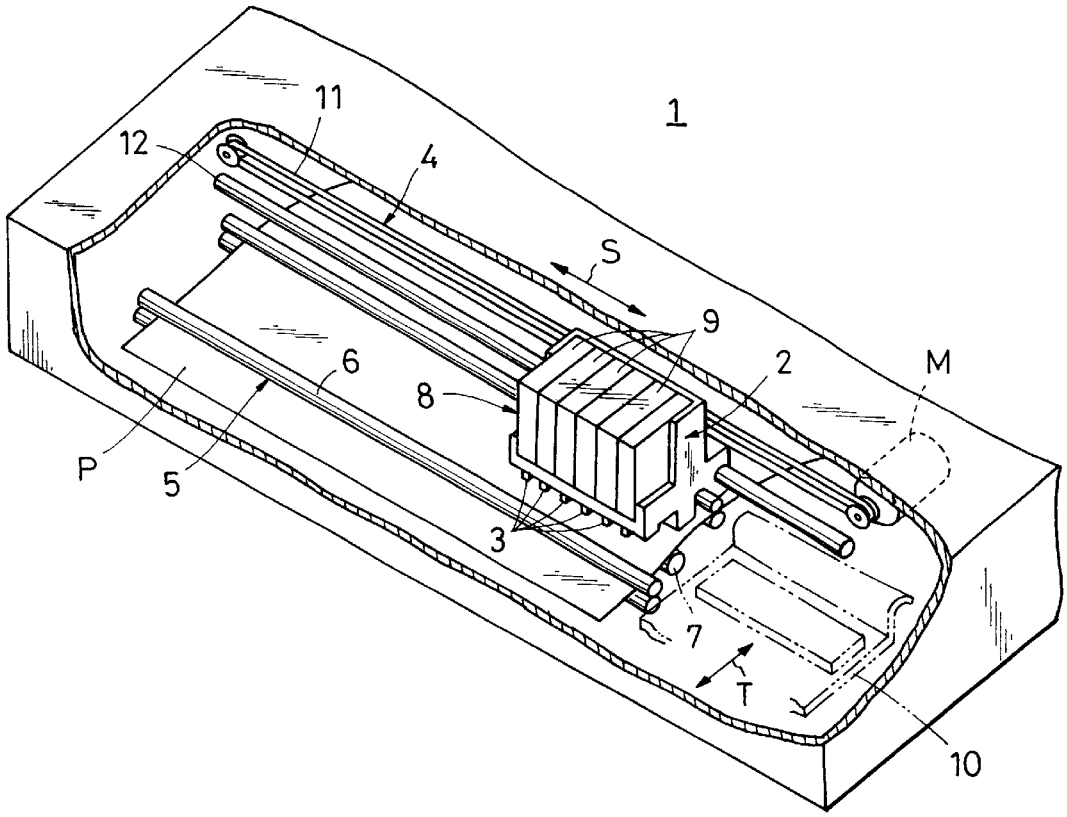
FIG. 1 is a partially broken schematic perspective view showing an ink jet recording apparatus in accordance with a first embodiment of the present invention.

Embodiments of the present invention will be described with reference to the drawings. In the drawings, the same reference numerals respectively denote the same or corresponding portions. FIG. 1 is a partially broken schematic perspective view showing an ink jet recording apparatus in accordance with a first embodiment of the present invention, FIG. 2 is a schematic perspective top view of a wiping device (cleaning device) 10 of the ink jet recording apparatus in accordance with the first embodiment of the present invention, and FIG. 3 is a schematic side view showing the state of the cleaning device 10 of the ink jet recording apparatus before the start of a wiping operation in accordance with the first embodiment of the present invention.

Figure 2:
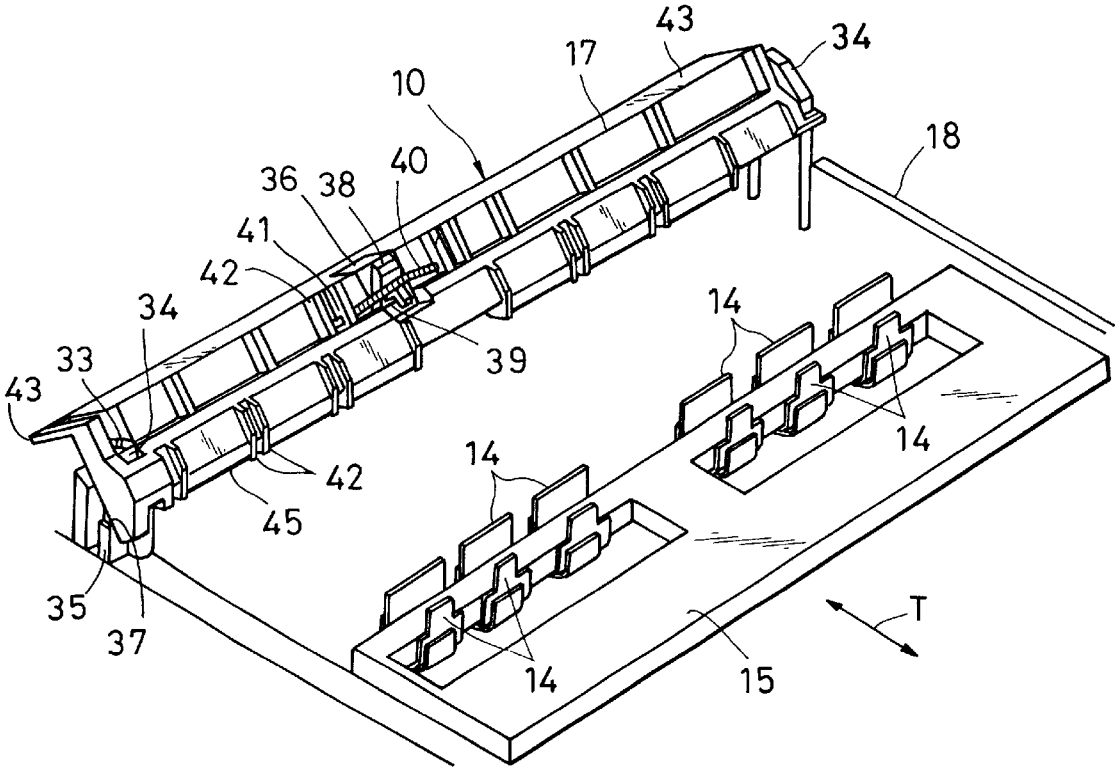
FIG. 2 is a schematic perspective top view showing a wiping device of the ink jet recording apparatus in accordance with the first embodiment of the present invention.
Figure 3:
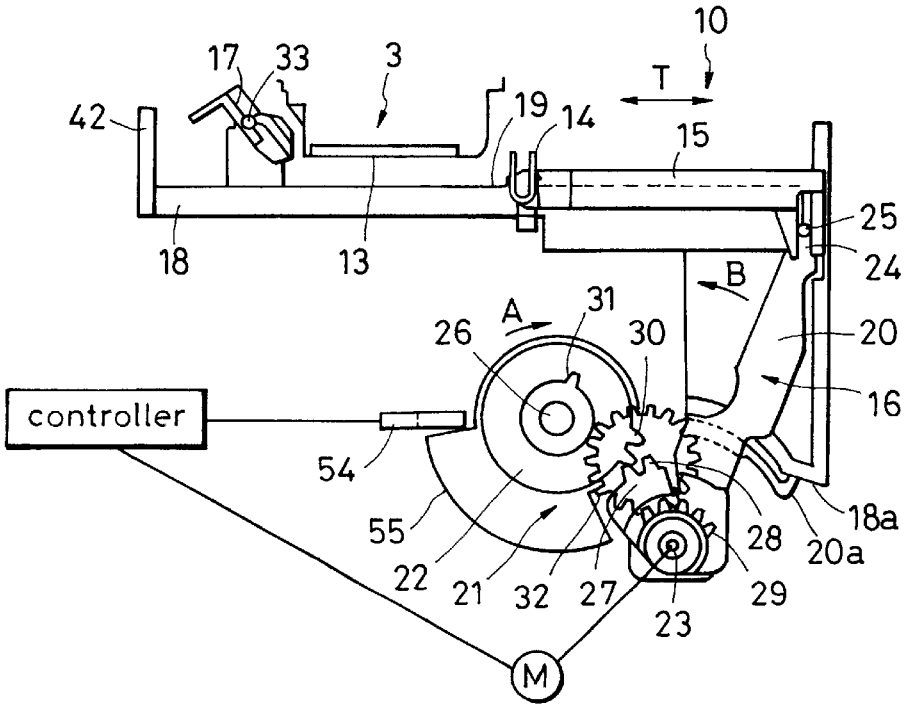
FIG. 3 is a schematic side view showing the state of the wiping device of the ink jet recording apparatus before the start of a wiping operation in accordance with the first embodiment of the present invention.

Referring to FIGS. 1 to 3, the ink jet recording apparatus 1 comprises a driving motor M as a driving source, a carriage 2 for loading ink jet recording heads 3 as discharge elements thereon, a transmission mechanism 4 for reciprocating the carriage 2 by the driving motor M, a feed mechanism 5 for transferring (feeding) recording paper P as a recording medium, and the cleaning device 10 for cleaning (wiping) the nozzle surfaces in order to recover discharge of the recording heads 3. In this ink jet recording apparatus 1, the recording paper P is fed by feed rollers 6 of the feed mechanism 5, and predetermined recording is performed on the recording paper P by the recording heads 3 on a platen 7.

An ink jet cartridge 8 mounted on the carriage 2 comprises the recording heads 3 as discharge elements and ink tanks 9 as ink storage units, which are integrated, and is detachably held (mounted) on the carriage 2 as a member for loading the recording heads thereon. To the recording heads 3 are respectively supplied inks contained in the ink tanks 9. In this embodiment, the carriage 2 and the recording heads 3 are provided so that complementary joint surfaces of both members are brought into proper contact to achieve and maintain desired electric connection therebetween.

The recording heads 3 are respectively ink jet recording heads for recording by applying energy to a plurality of energy generators (for example, electrothermal transducers) respectively provided within a plurality of nozzles corresponding to record signals to selectively discharge inks from the plurality of nozzles. Each of the recording heads 3 discharges ink by using thermal energy, and comprises an electrothermal transducer for generating the thermal energy. In each of the recording heads 3, for recording, ink is discharged from a nozzle by way of pressure changes caused by growth and shrinkage of bubbles due to film boiling which is produced by the thermal energy generated from the electrothermal transducer. An electrothermal transducer is provided corresponding to each of the nozzles so that when a pulse voltage is applied to the corresponding electrothermal transducer according to a record signal, ink is discharged from the corresponding nozzle.

In FIG. 1, the carriage 2 is connected to a driving belt 11 of the transmission mechanism 4 for transmitting the driving force of the driving motor M and is slidably guided and supported in the main scanning direction along two guide shafts (or a single guide shaft) 12 which are provided in parallel with each other so as to be driven by the driving motor M. Therefore, the carriage 2 is reciprocated along the guide shafts 12 by normal rotation and reverse rotation of the driving motor M.

The ink jet recording apparatus 1 shown in the drawing comprises the platen 7 provided opposite to the nozzle surface 13 in which the nozzles of the recording heads 3 are formed. By applying a record signal to the recording heads 3 to discharge ink at the same time that the carriage 2 for loading the recording heads 3 thereon is reciprocated by the driving force of the driving motor M, recording is carried out over the entire width of the recording paper P as the recording medium is transferred over the platen 7.

In the ink jet recording apparatus 1, a recovery device for recovering defective discharge of the recording heads is provided at a desired position (for example, a position corresponding to the home position) out of the range of reciprocation (out of the recording region) for the recording operation of the carriage 2 on which the recording heads 3 are loaded. Such a recovery device generally comprises a cap member for capping the nozzle surfaces 13 of the recording heads 3. Upon capping ink is forced to be discharged from the nozzles by a suction device (a suction pump or the like) provided in the recovery device in linkage with capping of the nozzle surface 13 by the capping member, thereby recovering discharge by removing viscous ink or bubbles in the ink flow passages of the recording heads 3. In addition, by capping of the nozzle surface 13 of the recording heads during non-recording, it is possible to protect the recording heads 3 and prevent drying of the inks.

In FIGS. 1 to 3, the wiping device 10 as the cleaning device can be provided together with the recovery device or provided at a position corresponding to the home position where the recovery device is disposed. The cleaning device 10 comprises blades 14 as wiping members for wiping the nozzle surface 13 of the recording heads 3 to clean the nozzle surface 13; a blade holder 15 for supporting the blades 14, and being movable along a guide portion 19 (FIG. 3); and an operating mechanism 16 for reciprocating the blade holder 15. The blades 14 for cleaning the nozzle surface 13 of the recording heads 3 are made of an elastic material such as rubber or the like, and are held at an end of the blade holder 15 in the form shown in the drawings. Like the recovery device, the blades 14 are operated by an appropriate motor and transmission mechanism to be pushed on the nozzle surface 13 of the recording heads 3 in order to clean the nozzle surface by wiping it.

Therefore, after recording by the recording heads (discharge elements) 3, the recording heads 3 are positioned at the home position, and the cleaning device (wiping device) 10 is relatively moved so that the blades (wiping members) 14 are pushed and slid on the nozzle surface 13 to be wiped. As a result, it is possible to wipe off the ink which adheres to the nozzle surface, as well as dew, other wet matter, or dust such as paper powder or the like, thereby cleaning the nozzle surfaces 13 of the recording heads 3.

In FIGS. 1 to 3, the carriage 2 on which the recording heads 3 are loaded is reciprocated in the main scanning direction shown by arrow S in FIG. 1. The wiping device 10 is disposed at the home position of the recording heads 3 in order to clean (wipe) the nozzle surfaces 13 of the recording heads 3 loaded on the carriage 2. In the ink jet recording apparatus of the present invention, the cleaning device 10 comprises the blades 14, the blade holder 15 at one end of which the blades 14 are supported, and which can be reciprocated in the direction of arrow T along the guide portion 19 of a base 18, the operating mechanism 16 for reciprocating the blade holder 15, and a rotatable blade cleaner 17 for cleaning the blades 14.

The blades 14 are provided on the blade holder 15 which is guided along the guide portion 19 of the base 18 which supports various other parts of the apparatus, so as to be moved (reciprocated) in parallel with the horizontal direction of FIG. 3. Each of the blades 14 shown in FIG. 3 has a U-shaped cross-section so as to clean the nozzle surfaces 13 of the recording heads 3 by wiping the nozzle surfaces with both ends of the blade. However, the form of the blades 14 is not limited to this, and each of the blades 14 may have a single end or at least three ends according to the form and performance of the recording heads 3. Besides the U-shaped form, for example, a plurality of blades 14 may be arranged at predetermined intervals. The blades 14 are made of, for example, an elastic rubber material such as synthetic rubber, silicone rubber or the like, or a plastic material having desired elasticity.

The blade holder 15 has the form of a rectangular flat plate, and comprises two openings for attaching the blades 14 in a number (in the example shown in the drawings, six) corresponding the number of the recording heads 3 loaded on the carriage 2. The blade holder 15 is reciprocated by the operating mechanism 16 in the directions shown by arrow T along the guide portion 19 of the base 18.

In FIG. 3, the operating mechanism 16 for reciprocating the blade holder 15 is rotatably pivoted on the base 18 by a pivotal shaft 23, and comprises a blade arm 20 having an end connected to the blade holder 15, and a gear mechanism 21 for transmitting driving force from a driving gear driven by a driving motor, which is not shown in the drawing, to the blade arm 20. The blade arm 20 is connected to the blade holder 15 by engagement between a long groove 24 of the blade holder 15 and a pin 25 provided at the end of the blade arm 20.

The gear mechanism 21 for transmitting the driving force of the driving motor to the blade arm 20 comprises a driving gear 22 driven by a motor not shown in the drawing, and a driven gear 27 for pivotally driving the blade arm 20. The driven gear 27 comprises a forward movement gear member 28 integrally provided on the pivotal shaft 23 for pivotally supporting the blade arm 2, for moving forward the blade holder 15; and a backward movement gear member 29 for moving backward the blade holder 15. The driving gear 22 driven by the driving motor comprises a gear member 30 which is engaged with the forward movement gear member 28, a gear member 31 which is engaged (gear-connected) with the backward movement gear member 29 through an idle gear 32, for driving the backward movement gear member 29 in the reverse direction, and a light shielding portion 55. To the base 18 is fixed an optical sensor 54 which is turned on and off by the operation of the light shielding portion 55 with rotation of the driving gear 22.

In each of the gear members 28 and 29 on the blade arm side, and the gear members 30 and 31 on the driving gear side, the gear teeth are formed at predetermined positions so that the driving force is transmitted to the blade arm 20 only when combinations of these gear members are rotating. By rotating the driving gear 22 in a direction, the blade arm 20 is reciprocated to reciprocate the blade holder 15 and the blades 14 through the long groove 24 and the pin 25. In this driving mechanism, the drive frequency of the driving motor is appropriately selected by rotating the driving motor and the driving gear 22 in a predetermined direction, thereby moving the blade holder 15 and the blades 14 at any desired speed during forward movement and backward movement.

In FIGS. 2 and 3, the blade cleaner 17 for cleaning by wiping the ink which adheres to the blades 14 is rotatably pivoted on the base 18. The blade cleaner 17 has a substantially L-shaped section and comprises shafts 33 provided at both ends thereof. The blade cleaner 17 is rotatably provided by respectively engaging the shafts 33 with the bearings 34 on both sides of the base 18. The base 18 comprises a stopper 35 provided so as to allow free rotation of the blade cleaner in one direction (counterclockwise), but prevents rotation in the opposite direction (clockwise) when the stopper 35 is abutted on an abutting portion 37 of the blade cleaner 17.

Figure 8A:
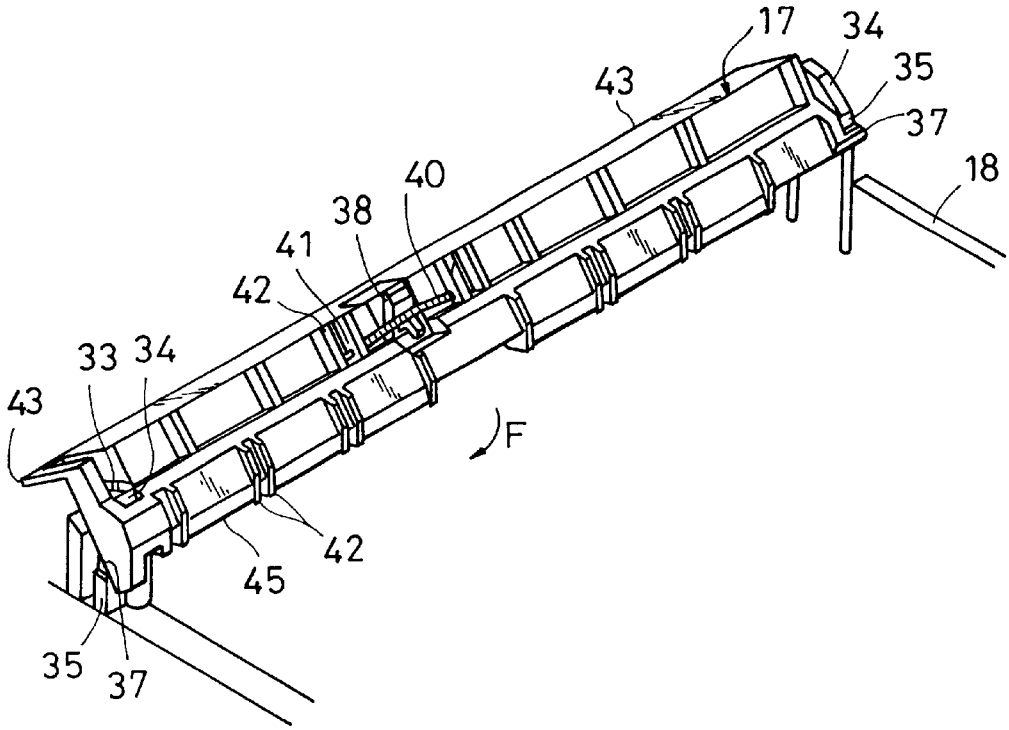
FIG. 8A is a schematic perspective view showing the state of the blade cleaner shown in FIG. 2 during an operation.
Figure 8B:
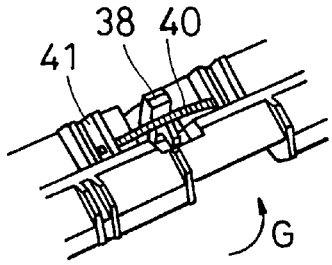
FIG. 8B is a schematic perspective view showing the state of the central portion of the blade cleaner when it is rotated to the non-operation position.

FIG. 8A is a schematic perspective view showing the state of the blade cleaner 17 during the operation, and FIG. 8B is a schematic perspective view showing the state of the central portion of the blade cleaner 17 when it is rotated to the non-operation position. In FIGS. 2 and 8A, a notch portion 36 is provided at the center of the blade cleaner 17 so that a fulcrum 38 is extended into the notch portion 36 from the base 18. The fulcrum 38 contacts the vicinity of the rotation center of the blade cleaner 17 from above to support the central portion of the elongated blade cleaner 17 in such a manner that the rotation load is decreased. Therefore, a contact portion 39 of the fulcrum 38 at the center of the blade cleaner 17 is formed as a rib in a tapered shape.

An urging spring 40 is provided so that the blade cleaner 17 is urged to abut on the stopper 35. The spring 40 comprises a contact coil spring in which the spring portions at both ends of a general contact coil extension spring are removed. Such a spring 40 is loaded on the fulcrum 38 in the central portion of the blade cleaner 17, and has both ends inserted into a mounting portion 41 provided on the wall 42 of the blade cleaner 17. The spring 40 is provided on the mounting portion 41 having both ends provided on the wall 42 of the blade cleaner 17 so that the spring 40 cannot be moved by a predetermined looseness or more in the axial direction and radial direction of the spring 40, but the rotation of the spring is not limited so as to permit rotation to some extent.

Since the spring 40 is positioned above the rotation center of the blade cleaner 17, when the blade cleaner 17 is rotated in the direction of arrow G shown in FIG. 8B, the fulcrum 38 is separated from the spring mounting portion 41 of the blade cleaner 17 to increase the angle and deformation of the spring 40, thereby increasing the reaction force of the spring 40. An angled screen 43 for preventing upward scattering of ink is provided on the blade cleaner 17 having a substantial L-shaped section, thereby effectively preventing scattering of ink.

In FIG. 3, the upper ends of the blades 14 of the wiping device 10 are set at a position higher than the discharge surfaces 13 of the recording heads 3 and hither than the lower surface of the blade cleaner 17 by a predetermined amount (for example, about 0.1 mm to 2.0 mm) to form the predetermined amount of overlap margin (interference margin). In order to easily rotate the blade cleaner 17, a slight tolerance (for example, about 0.05 mm to 0.5 mm) is provided on the bearing portion 34.

Figure 4:
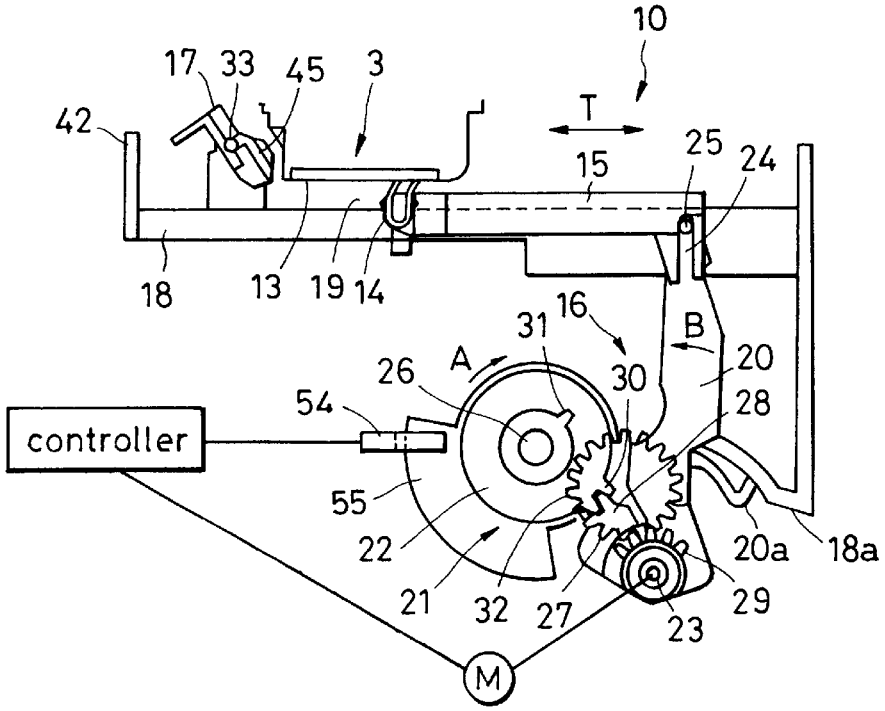
FIG. 4 is a schematic side view showing the state of the wiping device of the ink jet recording apparatus during the operation of wiping a nozzle surface in accordance with the first embodiment of the present invention.
Figure 5:
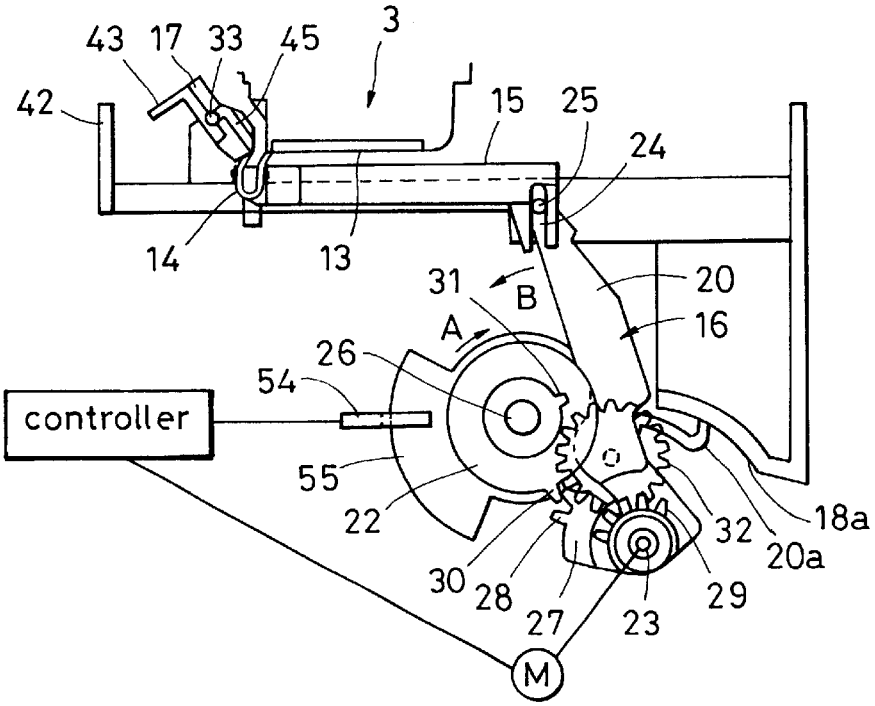
FIG. 5 is a schematic side view showing the state of the wiping device shown in FIG. 4 at the time of completion of the operation of wiping a nozzle surface.
Figure 6:
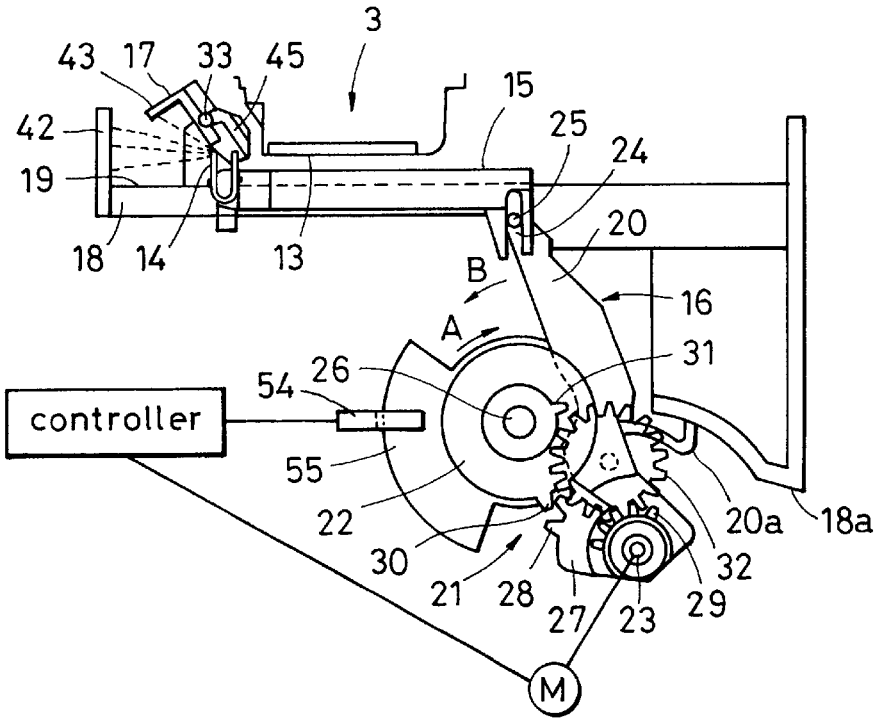
FIG. 6 is a schematic side view showing the state of the wiping device shown in FIG. 4 at the time of blade cleaning after the completion of the operation of wiping a nozzle surface.
Figure 7:
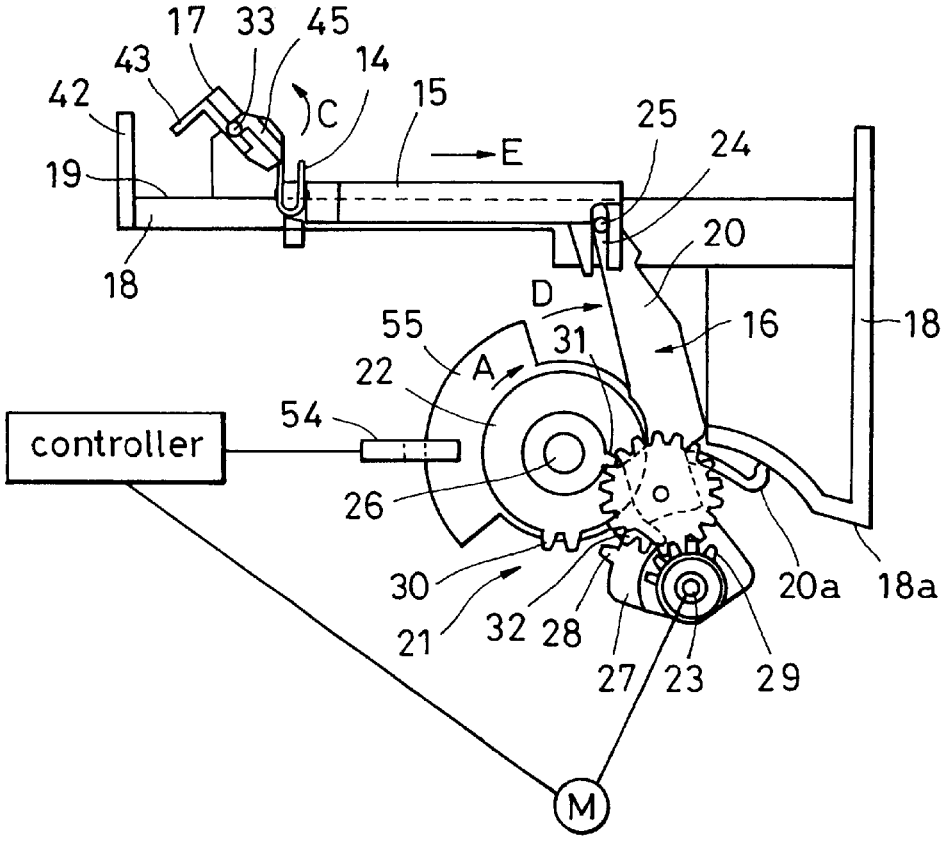
FIG. 7 is a schematic side view showing the state of the wiping device shown in FIG. 4 at the time of recovery of a blade holder after the completion of blade cleaning.

FIG. 4 is a schematic side view showing the state of the cleaning device (wiping device) 10 during the operation of wiping the nozzle surface, FIG. 5 is a schematic side view showing the state of the cleaning device after completion of the operation of wiping the nozzle surface, FIG. 6 is a schematic side view showing the state of the cleaning device at the time of blade cleaning, and FIG. 7 is a schematic side view showing the state of the cleaning device during recovery of the blade holder after completion of blade cleaning. The operation (particularly, the operation related to the blades 14) of the cleaning device (wiping device) 10 will be described with reference to FIGS. 3 to 7.

Figure 14:
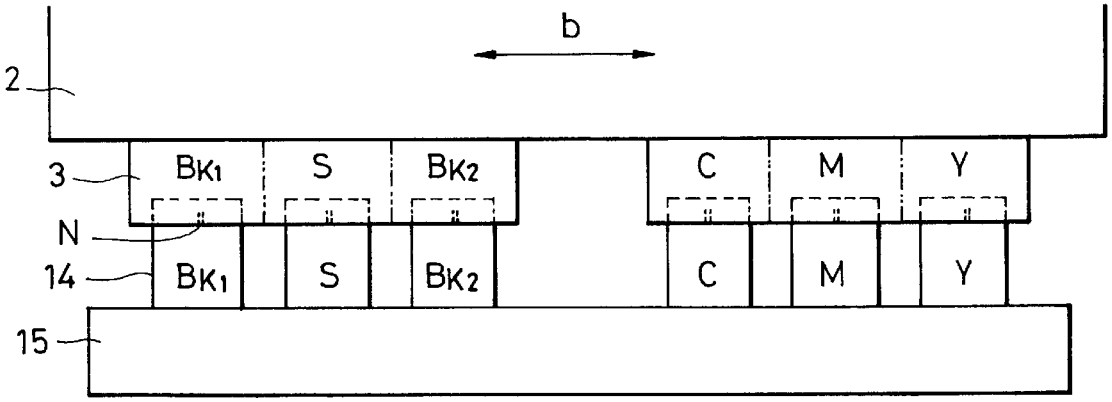
FIG. 14 PRIOR ART
FIG. 14 is a schematic view of a wiping device as viewed from the movement direction of a recording medium.
Figure 15:
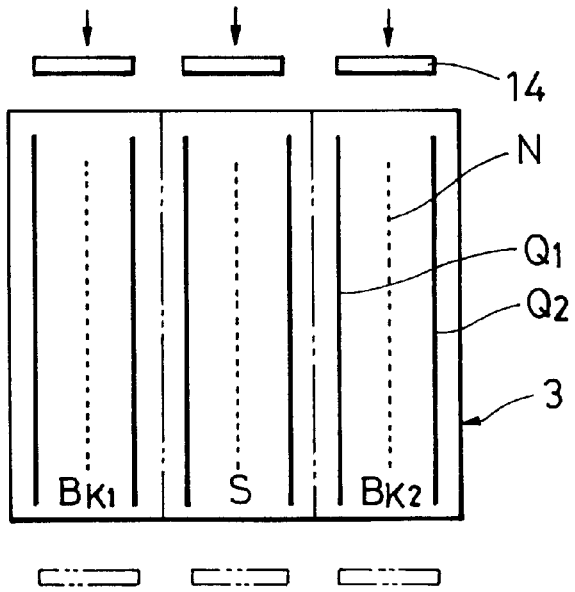
FIG. 15 PRIOR ART
FIG. 15 is a plan view the state of a discharge element after wiping as viewed from the direction of ink discharge.
Figure 16:
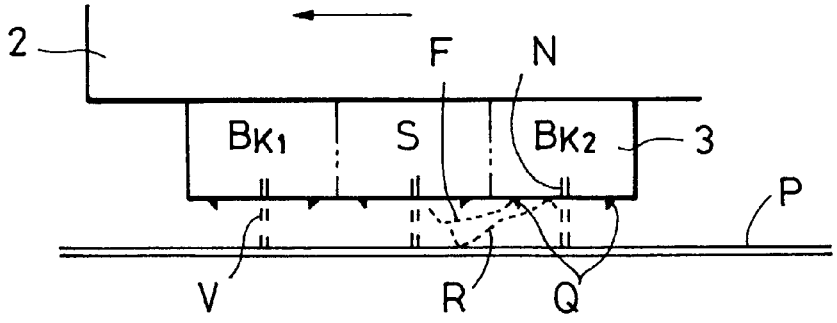
FIG. 16 PRIOR ART
FIG. 16 is a schematic view showing the state of ink droplets-during printing as viewed from the movement direction of a recording medium.

First, the carriage 2 on which the discharge elements (recording heads) 3 are loaded is moved to the position similar to that shown in FIG. 14 where each of the blades 14 is opposite to the corresponding discharge element. Next, the blades 14 are moved to the left direction in the drawing from the state shown in FIG. 3 to clean the nozzle surfaces 13 by wiping off ink and stains which adhere to the nozzle surfaces 13 of the recording heads 3, as shown in FIG. 4. Namely, when the blade holder 15 is moved in the direction of arrow T along the guide portion 19 of the base 18, the nozzle surfaces 13 of the recording heads 3 are wiped by the ends of the blades 14 to clean the nozzle surfaces 13 by removing the ink and stains which adhere to the nozzle surface 13 to be wiped. Namely, the operation of wiping the nozzle surface 13 is carried out.

The blades 14 are moved by driving the driving gear 22 by the driving motor (not shown), and driving the forward movement gear member 28 of the blade arm 20 by the forward gear member 30 of the driving gear 22. As described above, the driving gear 22 comprises the forward movement gear member 30 and the backward movement gear member 31, which are integrally provided on the motor shaft 26. On the other hand, on the pivotal shaft 23 of the blade arm 20 are integrally provided the forward movement gear member 28 and the backward movement gear member 19.

Therefore, when the driving gear 22 is rotated from the state shown in FIG. 3 in the direction of arrow A, the forward movement gear member 30 is engaged with the gear member 28 to rotate the blade arm 20 in the direction of arrow B. As a result, the blades 14 are moved to the left in the drawing to create the state shown in FIG. 4, thereby starting the operation (wiping operation) of wiping the nozzle surface 13 of the recording heads 3 by the blades 14. At this time, in the state shown in FIG. 3, the optical sensor 54 is not shielded by the light shielding portion 55, and thus is turned on. However, in the course of movement to the state shown in FIG. 4, the optical sensor 54 is shielded by the light shielding part 55 and is thus turned off. In addition, during the wiping operation, the movement speed of the blades 14 is represented by P.

Next, when the driving gear 22 is further rotated in the direction of arrow A, the blades 14 pass through the entirety of the discharge surface 13 while wiping it, and then abut on a cleaning portion 45 of the blade cleaner 17. At this time, since the abutting portion 37 of the blade cleaner 17 abuts on the stopper 35, the blade cleaner 17 is not rotated, and thus the blades 14 slide on the cleaning portion 45 while being bent, as shown in FIG. 5. At the same time, the ink or the like which adheres to the ends of the blades 14 is wiped off by the blade cleaner 17 to clean the blades 14. In this case, since only the ends of the blades are cleaned, a large amount of ink still adheres to the remaining portions of the blades 14. However, in order to clean the nozzle surfaces 13 of the recording heads 3, it is sufficient to clean just the ends of the blades 14, and, therefore, it is sufficient from the functional viewpoint to carry out the above-mentioned blade cleaning operation.

After the blades 14 pass through the blade cleaner 17 while sliding thereon, the bent blades 14 are released and returned to the initial state (recovered), and thus the residual ink which adheres to the blades 14 is scattered to the left in the drawing, as shown in FIG. 6. In order to prevent the inside of the recording apparatus from being stained by scattering of the ink, the wall 42 is preferably provided at a position as near the blade cleaner as possible (on the left side of the drawing) for receiving the scattered ink. It is also effective to extend the angled screen 43 from the blade cleaner 17.

When the driving gear 22 is further rotated in the direction of arrow A, engagement between the forward movement gear member 30 of the driving gear 22 and the forward movement gear member 28 of the blade arm 20 is released, and the backward movement gear 31 of the driving gear 22 is engaged with the backward movement gear member 29 of the blade arm 20 through the idle gear 32 to transmit driving force. Therefore, the blade arm 20 starts to rotate in the reverse direction shown by arrow D. Thus, the blade holder 15 and the blades 14 also start to move in the reverse direction shown by arrow E (FIG. 7). In this case, when the blades 14 pass through the portion below the blade cleaner 17, the blade cleaner 17 is rotated in the direction of arrow C (FIG. 7) to be retracted by an amount corresponding to the overlap between the blades 14 and the blade cleaner 17.

Namely, the blades 14 pass through the blade cleaner 17 while pushing it aside. Therefore, scattering of the ink is significantly decreased. At this time, however, scattering of the ink is not completely prevented because the blades 14 are bent by an amount corresponding to the force of the spring 40 to urge the blade cleaner 17. The movement speed of the blades 14 from the time the blades 14 abut on the cleaning portion 45, as shown in FIG. 5, to the time the blades are returned in the reverse direction and pass through the blade cleaner 17 while pushing aside it after turnabout is represented by Q.

When the driving gear 22 is continuously rotated in the direction shown by arrow A, the blades 14 are returned to the state shown in FIG. 3 to complete the cleaning operation (the wiping operation). At this time, the forward movement gear member 30 of the driving gear 22 is separated from the forward movement gear member 28 of the blade arm 20 and is put into a free state. However, since the elastic arm 20*a* of the blade arm 20 is at the bottom of a cam 18*a* of the base 18, the blade arm 20 is not carelessly moved from the position shown in FIG. 3.

As described above, the blades 14 are reciprocated only by rotation of the diving motor (not shown) in one direction, and thus cleaning (the wiping operation) of the nozzle surface 13 of the recording heads 3 and cleaning (the blade cleaning operation) of the blades 14 themselves can be properly easily carried out in a single process. However, the blades 14 may be driven by normal and reverse rotations of the driving motor, as described above, or by using a parallel movement actuator such as a solenoid or the like. The above-described wiping speed P is generally set to a relatively low speed in consideration of the wiping property of the nozzle surface 13.

Although it is undesirable from the viewpoint of prevention of ink scattering to set the above-described blade cleaning speed Q to a too high value, the blade cleaning speed Q may be set to a value slightly higher than the wiping speed P. If a speed other than these speeds P and Q is R. the speed R is preferably set to as high a value as possible in order to increase the speed of a series of recovery operations. Therefore, these speeds have the relationship $P<Q<R$.

When the power source of the whole ink jet recording apparatus 1 of this embodiment is turned on from an off state, the driving speed of the driving gear 22 can be first set to an optimum value. Namely, with the sensor 54 turned off (shielded by the light shielding portion 55), the blades 14 contact the recording heads 3 or the blade cleaner 17, and thus the speed (for example, the wiping speed P) is set to a low value in consideration of ink scattering. With the sensor 54 turned on, the speed R is set to a high value in order to achieve a high speed. In this way, the movement speed of the blades 14 can be easily set to an optimum value or a value close to the optimum value according to the operation state thereof.

Figure 9:
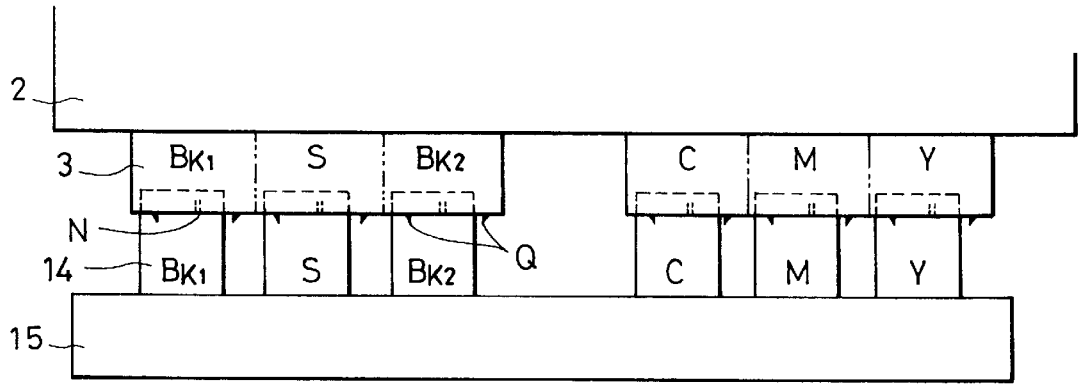
FIG. 9 is a schematic view showing the wiping device in accordance with the first embodiment during the second wiping operation of removing the ink forced or excluded to both sides of the wiping region or the reaction product thereof on the left side of a nozzle in the movement direction of a recording medium.
Figure 10:
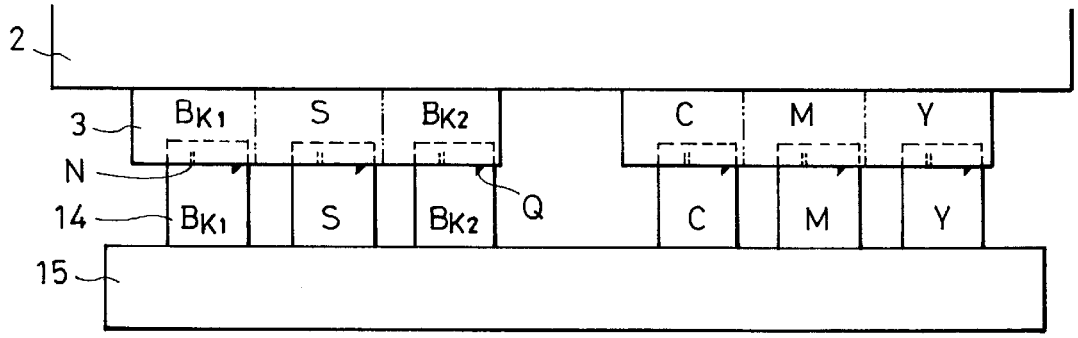
FIG. 10 is a schematic view showing the wiping device in accordance with the first embodiment during the second wiping operation of removing the ink excluded to both sides of the wiping region or the reaction product thereof on the right side of a nozzle in the movement direction of a recording medium.

The normal (first) wiping operation is described above. Next, the second wiping operation is described below with reference to FIGS. 9 and 10. FIG. 9 is a schematic view showing the wiping device when the ink forced or excluded to both sides of the wiping region on the left side of each of the nozzles is removed, as viewed from the movement direction of recording paper (the recording medium). FIG. 10 is a schematic view showing the wiping device when the ink excluded to both sides of the wiping region on the right side of each of the nozzles is removed, as viewed from the movement direction of recording paper (the recording medium).

First, the carriage 2 on which the discharge elements 3 are loaded is moved and positioned at the position shown in FIG. 9 which is shifted by the predetermined amount to the left from the position in the first wiping operation similar to that shown in FIG. 14. Then, the wiping operation is carried out according to the above-mentioned procedure. At this time, excluded ink accumulation Q1 on the left side of each of the nozzles N shown in FIG. 9 is wiped off by the corresponding blade 14. Next, the carriage 2 on which the discharge elements 3 are loaded is moved and positioned at the position shown in FIG. 10 which is shifted to the right by a predetermined amount from the position in the first wiping operation shown in FIG. 14. Then, the wiping operation is carried out according to the above-described procedure. At this time, excluded ink accumulation Q2 on the right side of each of the nozzles N is wiped off by the corresponding blade 14.

In this way, by shifting the relative position between the carriage 2 and the wiping device, the second wiping operation can be carried out for wiping outside of the region of the first wiping operation. The frequency of the second wiping operation can be appropriately determined for a predetermined number of sheets printed or a predetermined number of times of suction recovery. Of course, the first wiping operation and second wiping operation may be carried out each time wiping is to be effected.

Figure 11:
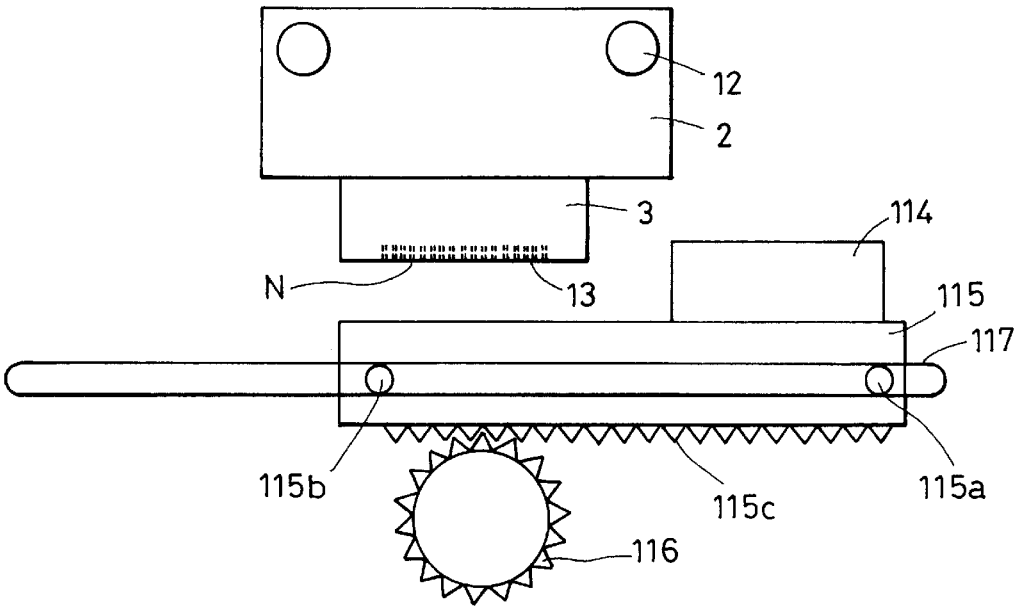
FIG. 11 is a schematic view showing the positional relationship between a wiping device and a discharge element during non-wiping in an ink jet recording apparatus in accordance with a second embodiment of the present invention.
Figure 12:
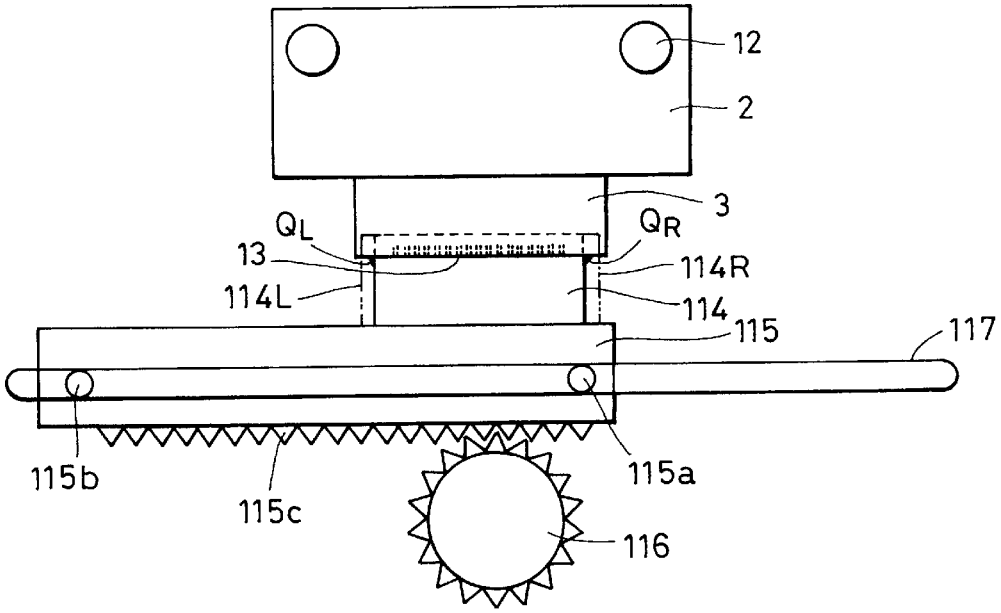
FIG. 12 is a schematic view showing the positional relationship between the wiping device and the discharge element during wiping in the ink jet recording apparatus in accordance with the second embodiment of the present invention.
Figure 13:
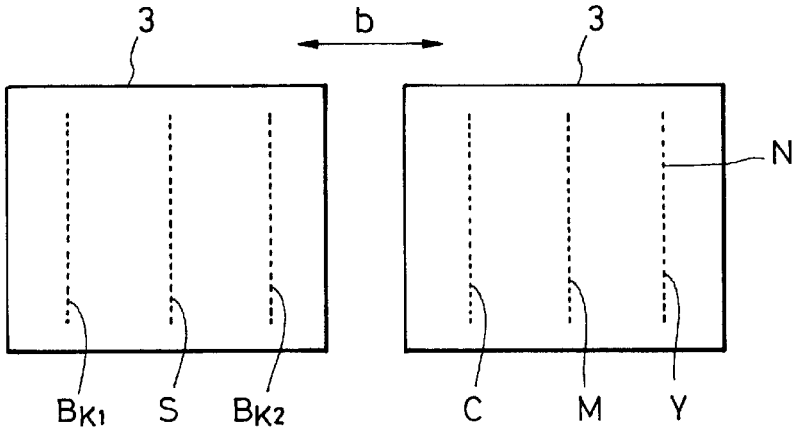
FIG. 13 PRIOR ART
FIG. 13 is a schematic plan view of a discharge element as viewed from the direction of ink discharge.

An ink jet recording apparatus in accordance with a second embodiment of the present invention will be described with reference to FIGS. 11 and 12. FIG. 11 is a schematic view showing the positional relationship between the wiping device and discharge elements during non-wiping in accordance with the second embodiment, and FIG. 12 a schematic view showing the positional relationship between the wiping device and discharge elements during wiping in accordance with the second embodiment. In FIGS. 11 and 12, the same portions as or equivalent portions to the portions in the above-described first embodiment are respectively denoted by the same reference numerals, and detailed description thereof is omitted.

The above-described embodiment relates to so-called longitudinal wiping in which wiping is carried out in parallel with the arrangement direction of a plurality of nozzles. However, this embodiment relates to so-called transverse wiping in which wiping is carried out in a direction substantially perpendicular to the arrangement direction of a plurality of nozzles.

In FIGS. 11 and 12, a blade holder 115 for holding a blade 114 is made movable in the transverse direction in the drawings by engaging shafts 115*a* and 115*b* in a guide hole 117 of a casing. A gear portion 115*c* is formed in the lower portion of the blade holder 15 to be engaged with a forward and backward gear 116 rotated by a driving mechanism (not to shown in the drawings). During normal printing and suction recovery, the blade 114 is positioned so as not to contact the carriage 2 during scanning of the carriage 2 (scanning in the direction perpendicular to the drawing).

In the first wiping operation, the carriage 2 is first moved in the scanning direction to be retracted to a position where the blade 114 does not contact the discharge elements 3 even if the blade 114 was to be moved to the left side of the drawing. Then, the forward and backward gear 116 is rotated by the predetermined amount in the counterclockwise direction in the drawing to move the blade 114 from the position shown in FIG. 11 to the position shown in FIG. 12. Next, the carriage 2 is moved in the direction perpendicular to the drawing so as to bring the blade 114 in contact (sliding) with the discharge elements 13 for performing the wiping operation. Then, the forward and backward gear 116 is rotated by a predetermined amount in the clockwise direction in the drawing to return the blade 114 to the position shown in FIG. 11.

Next, the second wiping operation in this embodiment will be described. The second wiping operation is carried out by shifting the relative positional relation between the discharge elements 3 and the blade 114 to a position different from that in the first wiping operation. First, the carriage 2 is retracted by the same method as the first wiping operation, and then the forward and backward gear 116 is rotated to position the blade 114 so that the right end thereof is at the position 114R shown in FIG. 12. Then, the carriage 2 is moved in the scanning direction to perform the operation of wiping the nozzle surface 13 of the discharge elements 3 to be wiped. At this time, excluded ink accumulation $Q_R$ on the right side of the nozzle line N shown in the drawing is wiped off.

Next, the carriage 2 is again retracted as described above, and the forward and backward gear 116 is then rotated in the counterclockwise direction to position the blade 114 so that the left end thereof is at the position 114L shown in FIG. 12. Then, the carriage 2 is moved in the scanning direction to perform the wiping operation. At this time, excluded ink accumulation $Q_L$ on the left side of the nozzle line N shown in the drawing is wiped off. The second embodiment shown in FIGS. 11 and 12 is suitable for wiping off (cleaning) a liquid, for example, such as pigment type ink or the like, which gradually accumulates and grows.

Although application to the apparatus using ink and the printability improving solution (treatment solution) is described above, the present invention is not limited to this. For example, with respect to the properties of the ink used, the present invention can be applied to an apparatus in which an image is formed by using anionic ink and cationic ink so as to decrease color bleeding between the adjacent printed colorants.

The present invention can also be applied to cases in which an ink set comprising a combination of at least two inks is used. At least a first ink of the set contains a pigment having a cationic group or a pigment and a pigment dispersant having a cationic group, and a resin including a colorant, and each of the first and a second ink of the set is an ink of a color selected from yellow, magenta, cyan, black, red, green and blue, with the second ink containing an anionic compound, or in which the anionic compound is a dye having an anionic group.

(Ink set)

Specifically, when carbon black is used as a pigment of an ink containing a pigment having a cationic group or a pigment and a pigment dispersant having a cationic group, and a resin containing a colorant, the ink comprises a black ink. However, such an ink can be combined with at least one color ink selected from a color ink containing a yellow coloring material, a color ink containing a magenta coloring material, a color ink containing a cyan coloring material, a color ink containing a red coloring material, a color ink containing a blue coloring material and a color ink containing a green coloring material to provide an ink set which can suitably be used for forming a color image.

When an ink containing at least one of a water soluble dye having an anionic group and a compound having at least an anionic group is used as the ink to be combined with black ink, an ion reaction takes place in boundaries on the recording medium, thereby effectively significantly suppressing bleeding. Conventional known examples of the water-soluble dye containing an anionic group include direct dyes, acid dyes, and the like. Conventional known examples of the compound having at least an anionic group include anionic surfactants, anionic group-containing polymer compounds, and the like. These examples include pigment dispersants, and the like. Examples of the water-soluble dye having an anionic group are given below.

(Yellow coloring material)

CI direct yellow 8, 11, 12, 27, 28, 33, 39, 44, 50, 58, 85, 86, 87, 88, 89, 98, 100, and 110

CI acid yellow 1, 3, 7, 11, 17, 23, 25, 29, 36, 38, 40, 42, 44, 76, 98, and 99

CI reactive yellow 2, 3, 17, 25, 37, and 42

CI food yellow 3

(Red coloring material)

CI direct red 2, 4, 9, 11, 20, 23, 24, 31, 39, 46, 62, 75, 79, 80, 83, 89, 95, 197, 201, 218, 220, 224, 225, 226, 227, 228, and 229

CI acid red 6, 8, 9, 13, 14, 18, 26, 27, 32, 35, 42, 51, 52, 80, 83, 87, 89, 92, 106, 114, 115, 133, 134, 145, 158, 198, 249, 265, and 289

CI reactive red 7, 12, 13, 15, 17, 20, 23, 24, 31, 42, 45, 46, and 59

CI food red 87, 92, and 94

(Blue coloring material)

CI direct blue 1, 15, 22, 25, 41, 76, 77, 80, 86, 90, 98, 106, 108, 120, 158, 163, 168, 199, and 226

CI acid blue 1, 7, 9, 15, 22, 23, 25, 29, 40, 43, 59, 62, 74, 78, 80, 90, 100, 102, 104, 117, 127, 138, 158, and 161

CI reactive blue 4, 5, 7, 13, 14, 15, 18, 19, 21, 26, 27, 29, 32, 38, 40, 44, and 100

(Black coloring material)

CI acid black 2, 4, 8, 51, 52, 110, 115, and 156

CI food black 1 and 2

(Solvent)

Examples of solvents for inks containing the above coloring materials for color inks include water, and solvent mixtures of water and water-soluble organic solvents. As the water-soluble organic solvents, the same solvents as described above in the first embodiment can be used. When such a color ink is adhered to the recording medium by the ink jet method (for example, a bubble jet method), the ink is preferably prepared to have desired viscosity and surface tension so as to have the above-described excellent ink jet discharge properties.

(Content of coloring material)

For example, when inks are used for ink jet recording the content of the colorant in each color ink may be appropriately selected so that the ink has excellent ink jet discharge properties, and desired color tone and density. However, as a measure, the content is preferably in the range of 3 to 50 wt %, for example, based on the total weight of the ink. The water content of an ink is preferably in the range of 50 to 95 wt % based on the total weight of the ink.

INK PREPARATIONS

Ink preparations will be described in detail below. In the examples, C-1 and C-2 were prepared as a dispersing solution of carbon black.

(Preparation of C-1)

C-1 was prepared as described below.

Cationic polymer P-1 (weight average molecular weight=11,000, pH of an aqueous solution=3.26) containing acrylamide and trimethylaminopropylacrylamide hydrochloride at a monomer weight ratio of 70:30 was used as a dispersant to prepare the carbon black dispersion C-1 below.

| | |
|---|---|
| Aqueous cationic polymer P-1 solution (solid content 20% by weight) | 40 parts |
| Carbon black #2600 (produced by Mitsubishi Chemical Co., Ltd.) | 20 parts |
| Diethylene glycol | 10 parts |
| Isopropyl alcohol | 10 parts |
| Water | 130 parts |

These materials were put in a batch type longitudinal sand mill (produced by Eimex) which was then filled with glass beads having a diameter of 1 mm as a medium, followed by dispersion under water-cooling for 3 hours. After dispersion, the solution had a viscosity of 28 cps and a pH of 4.05. The resultant dispersion was placed in a centrifugal separator to remove coarse particles, to obtain dispersion C-1 having an average diameter of 0.12 $\mu$m. The thus-obtained dispersion had a total solid content by weight of 10 wt %.

(Preparation of C-2)

C-2 was prepared as described below.

10 g of carbon black having a surface area of 230 $m^2/g$ and a DBP oil absorption of 70 ml/100 g, and 3.06 g of 3-amino-N-ethylpyridinium bromide were well mixed with 72 g of water, and then 1.62 g of nitric acid was added dropwise to the resultant mixture, followed by agitation at 70° C. Several minutes after, a solution obtained by dissolving 1.07 g of sodium nitrite in 5 g of water was added to the mixture, followed by further agitation for 1 hour. The resultant slurry was filtered with a filter (trade name: Toyo filter No. 2: produced by Advantis Co., Ltd.), and pigment particles were well washed with water, and then dried in an oven at 110° C. To the pigment was added water to prepare an aqueous pigment solution containing 10% by weight of pigment. By the above-described method, the group shown by the following chemical formula was introduced to the surfaces of carbon black particles.

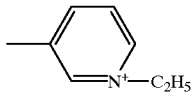

As the dispersing solution for a resin containing a colorant, MC-1 and MC-2 were prepared.

(Preparation of MC-1)

The following materials were mixed and dissolved.

| | |
|---|---|
| C.I. solvent black 3 | 5 parts by weight |
| Styrene-N,N-dimethylaminoethyl methylmethacrylate copolymer (molecular weight 40,000) | 20 parts by weight |
| Methyl ethyl ketone | 30 parts by weight |

The resultant mixture was subjected to phase inversion and emulsified by using acetic acid as a neutralizer to remove methyl ethyl ketone, to obtain an aqueous dispersion of microcapsules having a solid content of 20 wt % and an average particle diameter of 0.08 $\mu$m.

(Preparation of MC-2)

The same method as MC-1 was repeated except that the resin used for MC-1 was changed to styrene-N,N-dimethylaminopropyl methacrylate copolymer (molecular weight 35,000) to finally obtain an aqueous dispersion of microcapsules having a solid content of 20 wt % and an average particle diameter of 0.13 $\mu$m.

Each of the dispersions prepared as described above was mixed so that the solid content was as shown in Table 1, and each solvent was then mixed so that the glycerin content was 16 wt %, and the isopropyl alcohol content was 4.0 wt % to finally prepare an ink in which the total solid content of carbon black and the resin including a colorant in the ink was 8 wt %. In Table 1, C. B./MC represents the final solid concentration of the resultant ink. Namely, it is shown that ink A is prepared to contain carbon black and the resin including a colorant which have solid contents of 1.5 wt % and 6.5 wt %, respectively. This applies to the inks below. For inks A to C shown in Table 1, the amount of carbon black represents the total solid content of carbon black and the dispersant. On the other hand, for inks D to F, since no dispersant was used for carbon black, the amount of carbon black represents the amount of pure carbon.

TABLE 1

| Ink | C.B. Dispersant | Resin including colorant | C.B./MC |
|---|---|---|---|
| A | C-1 | MC-1 | 1.5/6.5 |
| B | C-1 | MC-1 | 3.0/5.0 |
| C | C-1 | MC-1 | 4.0/4.0 |
| D | C-2 | MC-2 | 1.5/6.5 |
| E | C-2 | MC-2 | 3.0/5.0 |
| F | C-2 | MC-2 | 4.0/4.0 |

The above-described embodiments relate to a serial recording type ink jet recording apparatus as an example in which the discharge elements are moved relatively to the recording medium. However, the present invention can also be applied to a line recording type ink jet recording apparatus in which recording is performed only by sub-scanning using a line type discharge element having a length which covers the entire length or part of the length of the recording medium. This produces the same effect as described above.

The present invention can also be applied to a recording apparatus using a single discharge element, a color recording apparatus using a plurality of discharge elements for recording with different color inks, a gradient recording apparatus using a plurality of discharge elements for recording in the same color with different densities, and a recording apparatus comprising a combination thereof. This also produces the same effect as described above. Furthermore, the present invention can be applied to any construction of arrangement of the recording heads and the ink tank, such as a construction using an exchangeable ink cartridge in which the recording heads (discharge elements) and the ink tank are integrated, and a construction in which the recording heads and the ink tank are separately provided and connected by using an ink supply tube or the like. In this case, the effect as described above can be obtained.

The present invention can also be applied to an ink jet recording apparatus using an electromechanical transducer, for example, such as a piezo element or the like. Particularly, the present invention exhibits excellent effects in an ink jet recording apparatus in which ink is discharged by using thermal energy. This is because such a type permits achievement of high-density and high-definition recording.

As described above, in the ink jet recording apparatus comprising the ink jet discharge elements and the wiping device for wiping the ink jet discharge elements, the second wiping operation, separate from the normal first wiping operation, is performed for wiping the discharge elements with the wiping device at a position shifted from the position in the first wiping operation in the direction perpendicular to the wiping direction. Therefore, the ink forced or excluded to both sides of each wiping region by the first wiping operation can be wiped off by the second wiping operation. It is thus possible to appropriately select the frequency of the wiping operations, and prevent dropping or transfer of the excluded ink onto a recording medium, thereby providing an ink jet recording apparatus capable of maintaining good image quality.

In addition, since the blade of the wiping device which contacts each of the discharge elements has a width smaller than the width of the surface of the discharge element to be wiped in the direction perpendicular to the wiping direction, the ink excluded to both sides of each wiping region by wiping easily accumulates. Therefore, by removing the ink excluded to both sides of the wiping region, it is possible to more efficiently prevent dropping or transfer of the excluded ink onto the recording medium, thereby providing an ink jet recording apparatus capable of maintaining good image quality. When the blade has a width larger than the width of the surface of each of the discharge element in the direction perpendicular to the wiping direction, the entire nozzle surface as the surface to be wiped can be cleaned by wiping, but the ink excluded by wiping flows and accumulates on a surface continuous with the surface to be wiped, for example, the vertical side, and contaminates peripheral members during scanning of the carriage. This problem can be solved by making the blades narrower than the surface to be wiped. This permits treatment and removal of the excluded ink over the entire nozzle surface, thereby preventing staining of the peripheral parts and the recording medium.

Since a plurality of discharge elements are provided so that they are arranged on substantially the same continuous plane, the ink jet recording apparatus has the above-described effect and the effect of facilitating mixing of different types of excluded inks on both sides of the wiping region, and thus previously suppressing dropping or transfer of the excluded ink onto the recording medium.

Since the wiping device is a longitudinal wiping device which is moved in the direction of the nozzle line in the discharge elements, the wiping amount per blade unit length is increased due to blade wiping of not only the periphery of a single nozzle but also the peripheries of a plurality of nozzles arranged in the direction of the nozzle line, thereby inevitably increasing the amount of the ink excluded to both sides of each wiping region. Therefore, the present invention exhibits the above effects and the effect of permitting a more effective wiping operation. Namely, a transverse wiping device in which a blade is moved in the direction substantially perpendicular to the nozzle line wipes only the periphery of a single nozzle, but the longitudinal wiping device successively wipes the peripheries of a plurality of nozzles arranged in the direction of the nozzle line, thereby permitting the more effective wiping operation.

Since a plurality of discharge elements are provided, which include a discharge element for discharging a liquid containing a colorant, and a discharge element for discharging a liquid containing a substance for coagulating or making insoluble the colorant contained in the liquid containing the colorant, the present invention has the above effects, and the effect that growth of the mixed reaction product formed by mixing and reaction of the inks excluded to both sides of each wiping region is prevented by removing it before accumulation is increased to a predetermined level in the growth process in which the mixed reaction product gradually accumulates and grows.

The individual components shown in outline or designated by blocks in the drawings are all well-known in the image recording art and their specific instruction and operation are not critical to the operation or best mode for carrying out the invention.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink jet recording apparatus comprising:

a liquid jet discharge element;

wiping means for wiping a surface of the liquid jet discharge element in a wiping direction; and control means for controlling wiping operations of said wiping means, wherein said control means controls first and second separate wiping operations such that a relative position between said wiping means and said liquid jet discharge element in the second wiping operation is shifted by a predetermined amount, in a direction transverse to the wiping direction, from a relative position between said wiping means and said liquid jet discharge element in the first wiping operation, wherein said liquid jet discharge element is wiped in both the first and second wiping operations.

2. An ink jet recording apparatus according to claim 1, wherein a blade of the wiping means in contact with the jet discharge element has a width, in the direction transverse to the wiping direction, which is smaller than a width of the surface of the jet discharge element to be wiped.

3. An ink jet recording apparatus according to claim 1, further comprising a plurality of the jet discharge elements having discharge surfaces arranged in a substantially continuous plane.

4. An ink jet recording apparatus according to claim 1, wherein said let discharge element comprises nozzles aligned in an alignment direction and said wiping means moves relative to said let discharge element in the alignment direction.

5. An ink jet recording apparatus according to claim 1, further comprising a plurality of discharge elements including at least a discharge element for discharging a liquid containing a colorant, and a discharge element for discharging a liquid containing a substance for coagulating the colorant or making the colorant insoluble in the liquid containing the colorant.

6. An ink jet recording apparatus according to claim 1, further comprising a plurality of discharge elements including at least a discharge element for discharging a liquid containing at least a low-molecular-weight component and a cationic substance as a high-molecular-weight component, and a discharge element for discharging a liquid containing an anionic dye.

7. An ink jet recording apparatus according to claim 1, further comprising a plurality of discharge elements including at least a discharge element for discharging a liquid containing at least a low-molecular-weight component and a cationic substance as a high-molecular-weight component, and a discharge element for discharging a liquid containing anionic dye and pigment.

8. An ink jet recording apparatus according to claim 1, wherein said jet discharge element comprises a thermal energy generator for generating thermal energy used for discharging liquid.

9. An ink jet recording apparatus according to claim 8, wherein the thermal energy generator comprises an electrothermal transducer generating thermal energy for generating film boiling in the liquid.

10. An ink jet recording apparatus according to claim 1, wherein said jet discharge element comprises an electromechanical transducer for generating energy for discharging liquid.

11. A cleaning method for a jet recording apparatus, comprising the steps of:

providing a liquid jet discharge element;

wiping a surface of the liquid jet discharge element by relative movement of a wiping device and the liquid jet discharge element in a wiping direction; and controlling first and second separate wiping operations of the wiping device such that a relative position between the wiping device and the liquid jet discharge element in the second wiping operation is shifted by a predetermined amount, in a direction transverse to the wiping direction, from a relative position between the wiping device and the liquid jet discharge element in the first wiping operation, wherein the liquid jet discharge element is wiped in both the first and second wiping operations.

12. A method according to claim 11, wherein the wiping device comprises a blade in contact with the surface of the jet discharge element, the blade having a width, in the direction transverse to the wiping direction, which is smaller than a width of the surface of the jet discharge element to be wiped.

13. A method according to claim 11, wherein the jet discharge element comprises nozzles aligned in an alignment direction and the wiping device moves relative to the jet discharge element in the alignment direction.

14. A recording apparatus comprising:

at least one discharge element having a discharge face;

a wiper for wiping the discharge face of the at least one discharge element, a width of the wiper being less than a width of the discharge face of the at least one discharge element; and a controller for controlling wiper operations by causing relative movement between the wiper and the at least one discharge element, wherein the controller controls a first pass of the relative movement for removing a portion of matter disposed on the discharge face and a second pass of the relative movement, shifted from the first pass, for removing additional matter on the discharge face not removed in the first pass.

15. A recording apparatus according to claim 14, wherein the second pass is shifted from the first pass in a width direction of the wiper.

16. A recording apparatus according to claim 14, wherein the discharge element comprises nozzles aligned in an alignment direction and the wiper moves relative to the discharge element in the alignment direction.

17. A recording apparatus according to claim 14, further comprising a plurality of discharge elements including at least a colorant discharge element for discharging a liquid containing a colorant, and a process liquid discharge element for discharging a process liquid containing a substance for coagulating the colorant or making the colorant in the liquid containing the colorant insoluble.

18. A cleaning method for a recording apparatus, comprising the steps of:

providing at least one discharge element having a discharge face;

wiping the discharge face of the at least one discharge element with a wiper, a width of the wiper being less than a width of the discharge face of the at least one discharge element; and controlling wiper operations by causing relative movement between the wiper and the at least one discharge element, the wiper operation including a first pass of the relative movement for removing a portion of the matter disposed on the discharge face and a second pass of the relative movement, shifted from the first pass, for removing additional matter on the discharge face not removed in the first pass.

19. A method according to claim 18, wherein the second pass is shifted from the first pass in a width direction of the wiper.

20. A method according to claim 18, wherein the discharge element comprises nozzles aligned in an alignment direction and the wiper moves relative to the discharge element in the alignment direction.

* * * * *

UNITED STATES PATENT AND TRADEMARK OFFICE

CERTIFICATE OF CORRECTION

PATENT NO. : 6,231,157 B1
DATED : May 15, 2001
INVENTOR(S) : Saijo

It is certified that error appears in the above-identified patent and that said Letters Patent is hereby corrected as shown below:

Column 19,
Lines 23 and 25, "let" should read -- jet --.

Signed and Sealed this

Sixteenth Day of April, 2002

*Attest:*

*Attesting Officer*

JAMES E. ROGAN
*Director of the United States Patent and Trademark Office*